US005771300A

United States Patent [19]

Daniels

[11] Patent Number: 5,771,300

[45] Date of Patent: Jun. 23, 1998

[54] LOUDSPEAKER PHASE DISTORTION CONTROL USING VELOCITY FEEDBACK

[75] Inventor: Mark A. Daniels, Manlius, N.Y.

[73] Assignee: Carrier Corporation, Syracus, N.Y.

[21] Appl. No.: 723,160

[22] Filed: Sep. 25, 1996

[51] Int. Cl.[6] ..... G10K 11/16; H04R 3/00

[52] U.S. Cl. ..... 381/71.5; 381/96; 381/71.8

[58] Field of Search ..... 381/71, 96, 71.5, 381/71.8

[56] References Cited

U.S. PATENT DOCUMENTS

| | | | |
|---|---|---|---|
| 4,677,676 | 6/1987 | Eriksson | 381/71 |
| 4,677,677 | 6/1987 | Eriksson | 381/71 |
| 5,119,427 | 6/1992 | Hersh et al. | 381/71 |
| 5,588,065 | 12/1996 | Tanaka et al. | 381/59 |

OTHER PUBLICATIONS

*The Art Of Electronics,* Second Edition, p. 388, Paul Horowitz, 1989.

*Introduction To Electronics,* Bureau of Naval Personnel, Navy Training Course NAVPERS 10084; 1963, Chapter 7—Radio, pp. 109 and 110.

*Primary Examiner*—Forester W. Isen

[57] ABSTRACT

The velocity of the integral speaker coil and cone of the canceling loudspeaker of an ANC system corresponds to the sound being produced by the canceling loudspeaker. By sensing the velocity of the speaker coil/cone and comparing the sensed velocity to the driving signal from the controller, the response time and distances can be shortened.

8 Claims, 4 Drawing Sheets

LOUDSPEAKER PHASE DISTORTION CONTROL USING VELOCITY FEEDBACK

BACKGROUND OF THE INVENTION

In conventional active noise cancellation (ANC) schemes, the noise from the noise source is sensed and, responsive thereto, a loudspeaker located downstream is activated to produce a noise canceling signal. A dynamic pressure sensor, such as a microphone, located downstream of the loudspeaker senses the resultant noise, after noise canceling has taken place, and provides a feedback signal to the loudspeaker activation circuitry to correct the noise canceling signal from the speaker. A drawback of conventional active noise cancellation schemes is the cumulative physical distances serially required between the input noise sensor, the noise canceler and the error noise sensor. The physical distances reflect the time required to sense the noise, process the information, produce a canceling signal and to sense the result of the canceling signal with each step corresponding to a time delay which requires additional physical distance. The reduction of these time delays would result in a reduced package size thereby making ANC more commercially attractive.

It is well known that causality in ANC systems is a requirement for system stability and performance. In general, causality refers to the fact that the output of a system cannot precede an input. For ANC systems, causality requires that the summation of time lags or time delays, associated with all ANC system components, be less than the time it takes the incident pressure wave to travel from the input microphone to the control actuator.

Each component of an ANC system, for example the microphones, anti-aliasing filters, controller and loudspeaker, has an associated frequency response. That is, each element can potentially distort the input signal by some finite amount where this distortion can be frequency dependent. This type of distortion, at the component level, results in a filtering action in which the amplitude and phase of the input signal is changed. A concept associated with the phase change of the input signal is the group delay. This term is mathematically defined as the derivative of the phase-versus-frequency response of the measured input-to-output, signal transfer function. Conceptually, the group delay is a measure of the average delay associated with each component of an ANC system. These time delays are component and frequency dependent with the loudspeaker generally accounting for a significant portion of the total ANC system delay. For the loudspeaker, the largest group delays occur at, and near the resonance frequency of the cone/suspension system. This is where the gradient of the phase response is largest. For large loudspeakers (>12 inches in diameter) this delay can be in excess of 3 milliseconds.

SUMMARY OF THE INVENTION

Rather than just correcting the signal for driving the noise canceling loudspeaker responsive to the noise sensed by an error microphone, the present invention provides a feedback indicative of the loudspeaker cone velocity which is a direct indication of sound being produced. Essentially, a signal proportional to the speaker cone velocity is used as a feedback to the controller output for correcting the driving signal and thereby providing an undelayed correction.

It is an object of this invention to reduce distortion and therefore the associated group delay in loudspeakers.

It is also an object of this invention to provide an idealized source for usage in duct ANC systems.

It is another object of this invention to reduce phase or time delay distortion in bass-reflex-type loudspeakers.

It is a further object of this invention to reduce the group delay associated with loudspeakers in ANC systems so as to allow a shortening of the system plant length.

These objects, and others as will become apparent hereinafter, are accomplished by the present invention.

Basically, the velocity of the integral speaker coil and cone of the canceling loudspeaker of an ANC system corresponds to the sound being produced by the canceling loudspeaker. By sensing the velocity of the speaker coil/cone and comparing the sensed velocity to the driving signal from the controller, the response time and distances can be shortened.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
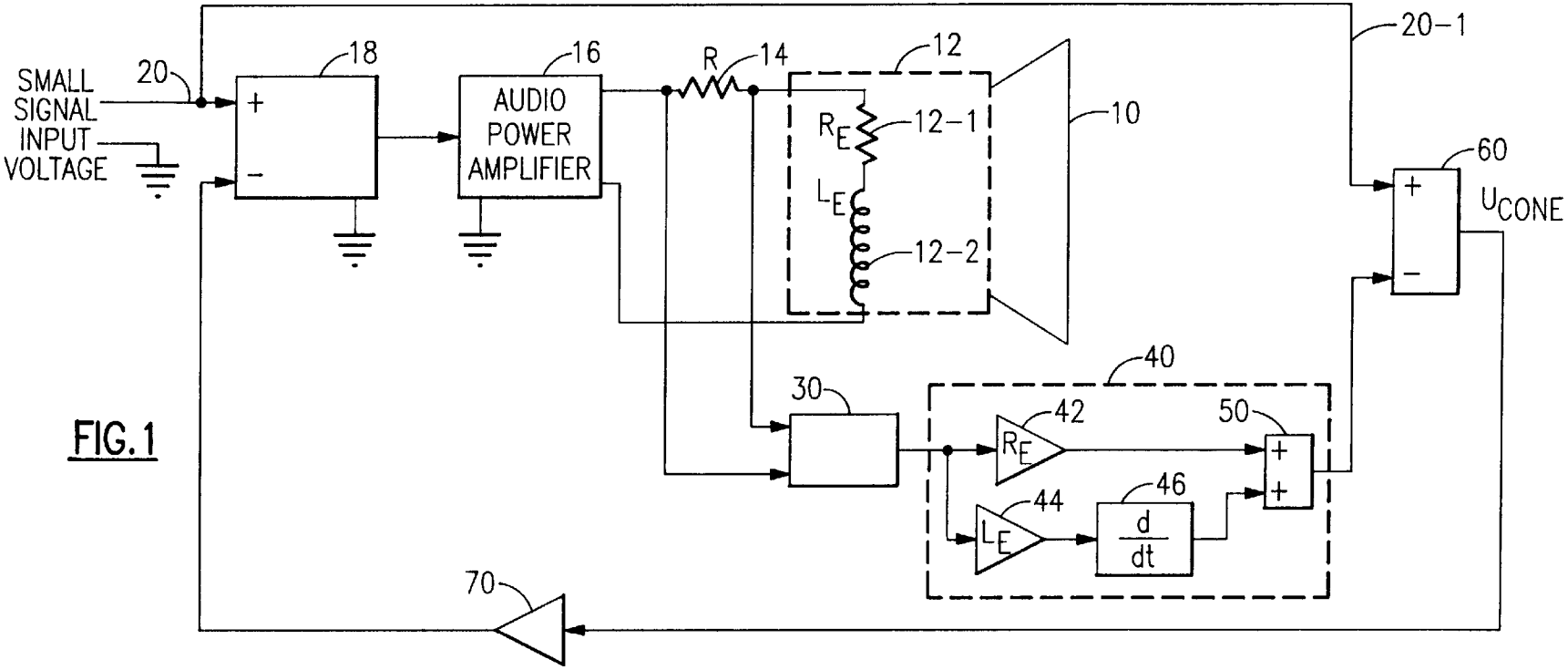
FIG. 1 is a schematic representation of the driving and theoretical feedback circuitry of the noise canceling loudspeaker of an ANC system.

In FIG. 1, the numeral 10 is the noise canceling loudspeaker of an ANC system such as is disclosed in U.S. Pat. Nos. 4,677,676 and 4,677,677. The present invention adds the loudspeaker's cone velocity feedback. As is conventional, loudspeaker 10 is driven through circuit 12 which includes a coil integral with a portion of the cone of the loudspeaker 10 and which moves in an annular air gap between the poles of the magnet when an electric current is supplied to the coil. The supplying of an electric current to the coil causes it to move relative to the magnet thereby moving the integral cone and producing sound representing the noise cancellation. With the cone of the loudspeaker 10 blocked from movement, the coil resistance and inductance can be determined. The blocked coil resistance is indicated in circuit 12 by resistor 12-1 having a resistance of $R_E$. Similarly, the blocked coil inductance is indicated in circuit 12 by coil 12-2 having an inductance of $L_E$.

Circuit 12 has a blocked coil resistance, $R_E$, which is very much greater than R, the resistance of power resistor 14 through which circuit 12 is connected to audio power amplifier 16. Amplifier 16 has a unity gain. The small signal input voltage which is supplied via line 20 represents the unamplified, uncorrected driving signal for speaker 10, which is supplied as a first input to adder 18 whose output is supplied to amplifier 16. Proportional 1 volt/amp circuit 30 is connected across power resistor 14 and receives two voltage inputs representing the voltage on either side of resistor 14. The difference in voltage is proportional to the current. With resistance R of power resistor 14 known, through Ohm's law, the current in resistor 14 can be determined and it is the same value as the current in circuit 12. Proportional 1 volt/amp circuit 30 converts the signal measured across resistor 14 to a voltage equal to the current and has an output corresponding to, i, the current though resistor 14, and this output is supplied to gain 42 and gain 44 in feedback circuit 40. Feedback circuit 40 is "theoretical" in the sense that values go to infinity at high frequency, as will be explained below. The gain 42 represents the blocked coil resistance, $R_E$, and has an output representing $i \cdot R_E$ which is supplied as a first input to adder 50. The gain 44 represents the blocked coil inductance, $L_E$, and has an output representing $i \cdot L_E$ which is supplied to differentiator 46 which differentiates the output from gain 44 and provides an output $i \cdot j \cdot \omega \cdot L_E$ which is supplied as a second input to adder 50. In the output $i \cdot j \cdot \omega \cdot L_E$, j is $\sqrt{-1}$, ω is the radian frequency. For high frequencies, ω effectively becomes infinite and the device will not be operative.

Adder 50 sums the inputs and has an output of $i(R_E + j \cdot \omega \cdot L_E)$ which equals $i \cdot Z_E$ where $Z_E$ equals $R_E + j \cdot \omega \cdot L_E$ and is representative of the combined blocked coil impedance. The output of adder 50 is supplied to adder 60 where it is subtracted from the small signal input voltage which is supplied via lines 20 and 20-1 as a second input to adder 60. The output of adder 60 is $U_{cone}$ which is the velocity of the loudspeaker cone. The output of adder 60 is supplied to gain 70 which generally has a value between fifty and one hundred. The output of gain 70 is supplied as a second input to adder 18 to provide a cone velocity feedback correction to the small signal input voltage supplied via line 20.

As noted above, feedback circuit 40 was identified as "theoretical" since, at high frequencies, terms approach infinity and make the circuit ineffective. Circuit 40 can be replaced with compensator network 140 of FIG. 2 which replaces gains 44 and differentiator 46 with filter 144. Filter 144 has an output of $i(s \cdot L_E/(1+s \cdot L_E/K))$ where $s=j \cdot \omega$ and K is a gain factor of about twenty. In comparing the output of filter 144 to that of differentiator 46 it will be noted that filter 144 adds the denominator value of $1+(s \cdot L_E/K)$. As a result, as s goes to infinity, $s \cdot L_E/(1+s \cdot L_E/K)$ goes to K.

In operation, starting with audio power amplifier 16, a driving current is supplied to the coil of speaker 10 represented by circuit 12 to drive the loudspeaker cone to thereby produce a canceling noise signal. The driving current will vary with the noise to be canceled and the cone will move with a varying velocity depending upon the canceling noise to be produced. Accordingly, the current supplied by amplifier 16 will vary. A voltage signal is obtained that is a direct measure of the current that is driving the loudspeaker 10. This is achieved by connecting proportional 1 volt/amp circuit 30 across power resistor 14. It should be noted that power resistor 14 is in series with the coil of the loudspeaker so that the current in power resistor 14 is the same as that supplied to the coil of loudspeaker 10. The signal from circuit 30 is fed into a compensation network 140 which models the net voltage drop across the blocked, loudspeaker's voice coil combined resistance and inductance.

The signal determined by adder 60, the difference between the small signal voltage input supplied by line 20-1 and the net voltage drop across the blocked coil resistance and inductance of circuit 12 determined by circuit 40 or 140, gives an indirect measurement of the loudspeaker's voice coil velocity and this is fed back via gain 70 to adder 18 to correct the voltage signal being supplied to the coil of loudspeaker 10. The theoretical model of the voltage drop, $V_D$, across the blocked coil resistance and inductance is given below in Equation 1, where t, represents a unit of time.

$$V_D(t) = i(t) \cdot R_E + L_E \cdot \frac{di(t)}{dt} \quad . \tag{1}$$

The s-domain and Fourier representations, respectively, of Equation (1) are:

$$V_D(s)=i(s) \cdot [R_E+L_E \cdot s]$$

or, $$V_D(j \cdot \omega)=i(j \cdot \omega) \cdot [R_E+L_E \cdot j \cdot \omega] \tag{2}.$$

In practice, to reduce high-frequency noise, Equation 1 must be implemented by leveling off the high frequency gain of the differentiator, i.e. the second term within the brackets of Equation 2. For minimum phase error, this should be done at a frequency at least ten times the maximum frequency of interest. A first order, compensation circuit achieves the required frequency and phase characteristics with the following Bode structure:

$$P_{LEAD} = R_E + \frac{j \cdot \omega \cdot L_E}{1 + j \cdot \omega \cdot \frac{L_E}{K}} \quad . \tag{3}$$

Figure 2:
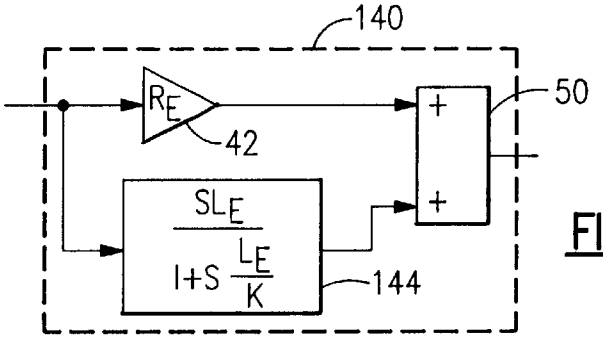
FIG. 2 is an alternative to the actual feedback of FIG. 1.

In the above equation gain K, should be about 20 for sufficient accuracy and this will be recognized as corresponding to block 140 in FIG. 2.

Before proceeding with the performance of the servo mechanism a background of the 1-dimensional wave propagation in a duct will be given. This is given to show that not only does the servo-mechanism reduce the group delay associated with the loudspeaker but that it also has other attractive features.

For wave propagation in a duct, the duct acts as an acoustic waveguide in that the dominant acoustic energy in the duct propagates as plane, acoustic waves (same acoustic pressure in any duct cross-section). For a semi-infinite duct with an acoustic source at one end, waves propagate only in the direction away from the acoustic source. However, if any downstream duct discontinuity exists, for example a branch or termination, an interaction of the reflection, transmission and dissipation of sound energy occurs. That is, at the discontinuity some of the acoustic energy associated with the wave is reflected back towards the source, some is transmitted downstream and the rest is dissipated as heat or frictional loss at the discontinuity. Therefore, we see that the sound field, or acoustic pressure, in a duct of finite extent can be described as two plane acoustic waves traveling in both forward (subscript f) and reverse (subscript r) directions. Mathematically, the following equations completely describe the plane-wave, acoustic pressure and particle velocity at any point in the duct (x, is the longitudinal duct coordinate).

$$P=(P_f e^{-j \cdot k \cdot x}+P_r \cdot e^{j \cdot k \cdot x}) \cdot e^{j \cdot \omega \cdot t},\ u=(U_f e^{-j \cdot k \cdot x}-U_r \cdot e^{j \cdot k \cdot x}) \cdot e^{j \cdot \omega \cdot t} U_f=P_f/\rho \cdot c,\ U_r=P_r/\rho \cdot c$$

In the above expressions P, is the total acoustic pressure, u is the total acoustic particle velocity, k is the acoustic wave number, 107 is the radian frequency, t is a time unit, ρ is the fluid density and c is the fluid sound speed in the duct.

For a loudspeaker mounted in an infinite baffle and a wave traveling freely (without boundaries) away from the source, the acoustic pressure, P, at a large distance, r, relative to the loudspeaker radius, a, can be expressed as:

$$P = \left( \frac{a^2 \cdot \rho}{2 \cdot r} \cdot e^{-j \cdot k \cdot r} \cdot j \cdot \omega \cdot u_{spk} \right) \cdot e^{j \cdot \omega \cdot t} = \left( \frac{a^2 \cdot \rho}{2 \cdot r} \cdot e^{-j \cdot k \cdot r} \cdot \dot{u}_{spk} \right) \cdot e^{j \cdot \omega \cdot t}$$

From this we see a basic and important difference between waves traveling in a 1-dimensional duct and those traveling in free space. Namely, that in a duct the forward, $P_f$, and reverse pressure waves $P_r$, are directly proportional to the acoustic velocity, u. In free space however, the acoustic pressure P, is proportional to the derivative of the source velocity $u_{spk}$, namely the acceleration of the loudspeaker diaphragm (i.e. $\dot{u}_{spk}=j \cdot \omega \cdot u_{spk}$). Therefore, for ANC in a duct an idealized loudspeaker would be one that would have approximately a unity output-velocity-to-input-voltage transfer function (this is essentially what the velocity-servo loudspeaker provides). For a free space ANC system, an idealized loudspeaker would be one that would have approximately a unity output-pressure-to-input-voltage transfer function (this is essentially what a baffled loudspeaker operating in free space is, however, a baffled loudspeaker utilizing acceleration feedback would enhance low-frequency performance).

The following is a discussion of the loudspeaker performance enhancements utilizing a loudspeaker with a closed-loop velocity servo operating with a feed back gain of approximately 50.

Figure 3:
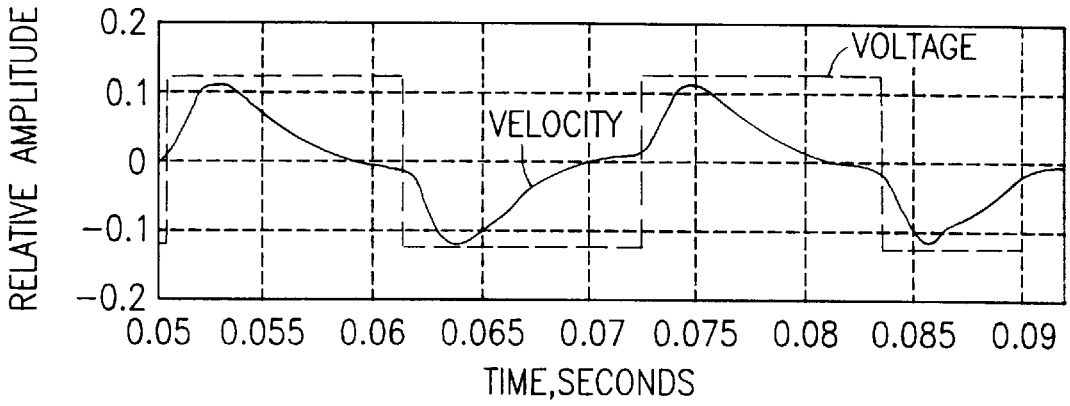
FIG. 3 is a comparison of the loudspeaker cone velocity vs. time for a 45 Hz square wave without velocity feedback.
Figure 4:
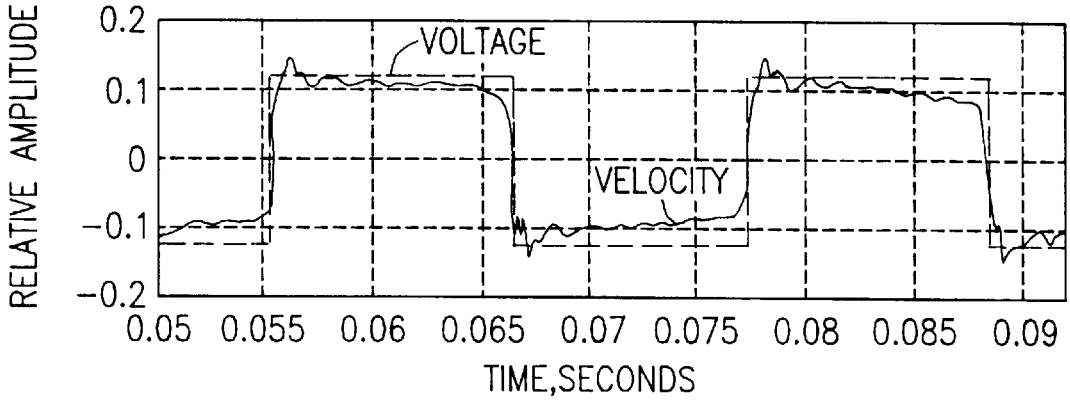
FIG. 4 is a comparison of the loudspeaker cone velocity vs. time for a 45 Hz square wave with velocity feedback.

FIGS. 3 to 4 compare an input voltage, 45 Hertz, square wave with the output cone velocity during open loop (no servo) and closed loop control, respectively. FIG. 3 indicates that the cone velocity of a standard loudspeaker (open loop) cannot follow an input square wave. Notice the large time lag between maximum input voltage and maximum cone velocity. In addition the cone velocity is unable to maintain a constant level after a relative maximum or minimum but rather decays at a rapid rate toward zero. Contrarily, in FIG. 4, under closed loop control, the loudspeaker's cone velocity essentially tracks the input square wave. A large reduction in the time lag between the input voltage and output cone velocity has occurred. In addition, there is little reduction in the relative velocity during positive and negative input cycles.

Figure 5:
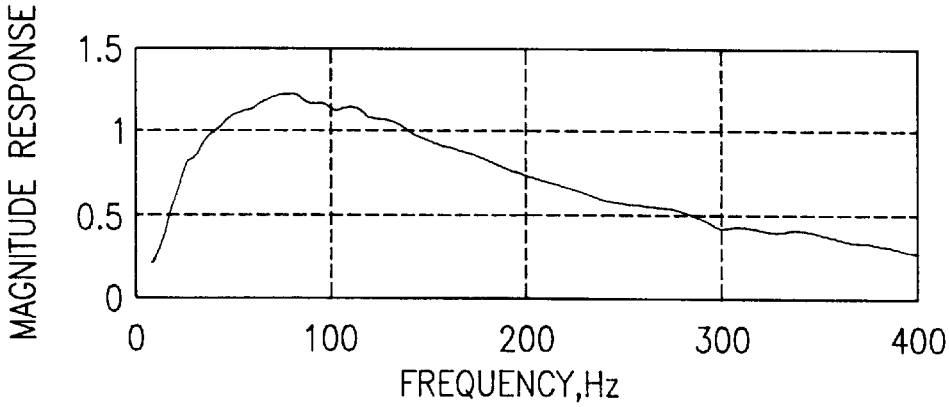
FIG. 5 shows the open loop magnitude response of a loudspeaker with broadband noise input.
Figure 6:
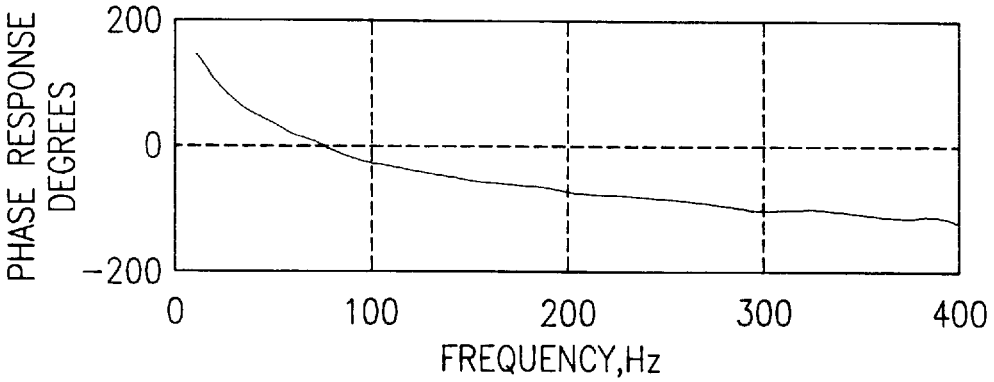
FIG. 6 shows the open loop phase response of a loudspeaker with broadband noise input.
Figure 7:
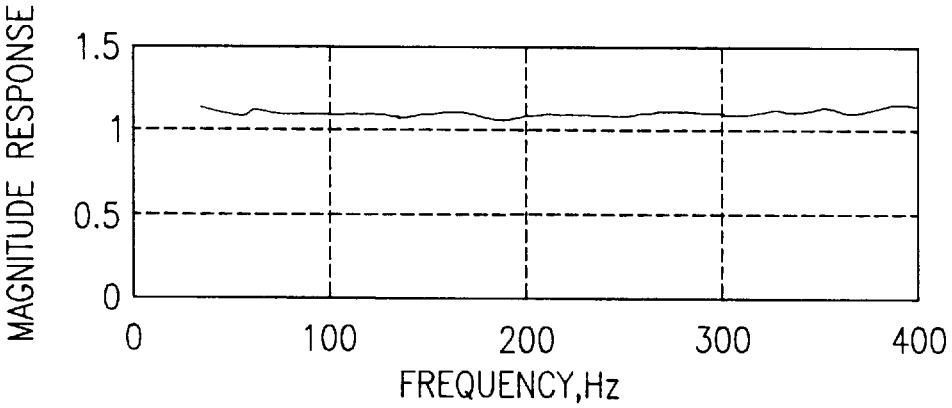
FIG. 7 shows the closed loop magnitude response of a loudspeaker with broadband noise input.
Figure 8:
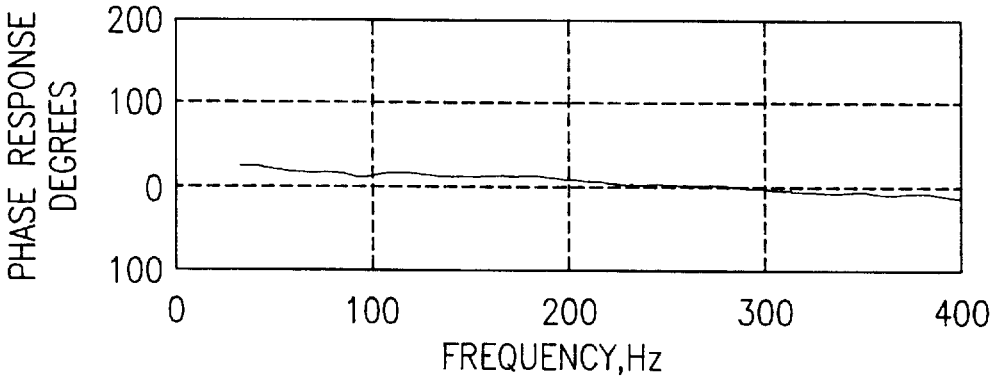
FIG. 8 shows the closed loop phase response of a loudspeaker with broadband noise input.

FIGS. 5 and 6 show the open loop (no servo) cone velocity amplitude and phase responses, respectively, when broadband noise is applied to the input. Broadband noise is a term used to describe a source that is constant in amplitude verses frequency over a desired frequency range. In FIG. 5 we see that the magnitude response has a peak at approximately, 75 Hertz. This corresponds to the resonance frequency of the cone suspension system. Notice in FIG. 6 that the gradient of the phase response is largest below this frequency. FIGS. 7 and 8 show the closed loop (servo) cone velocity and phase responses, respectively, when broadband noise is applied to the input. In FIG. 7, with the servo operative, the magnitude of the velocity response flattens out over much of the indicated range. In addition the gradient of the phase response in FIG. 8 is much less severe than that of open loop control as shown in FIG. 6.

Figure 9:
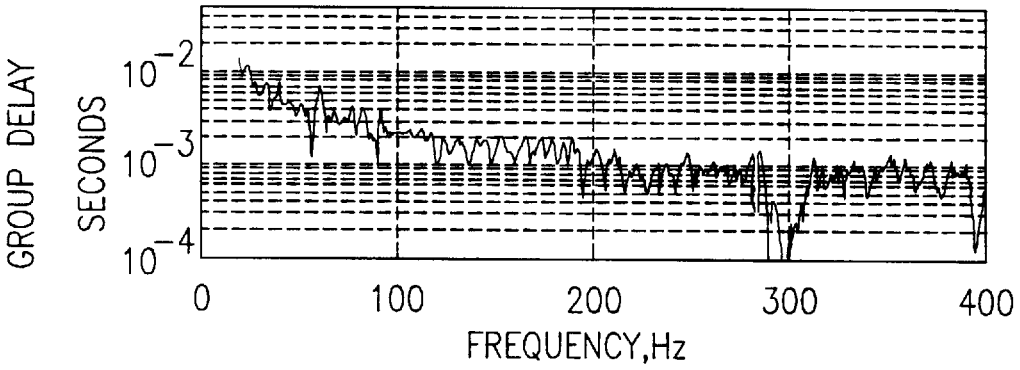
FIG. 9 is the group delay vs. frequency for an open loop or unservoed loudspeaker.
Figure 10:
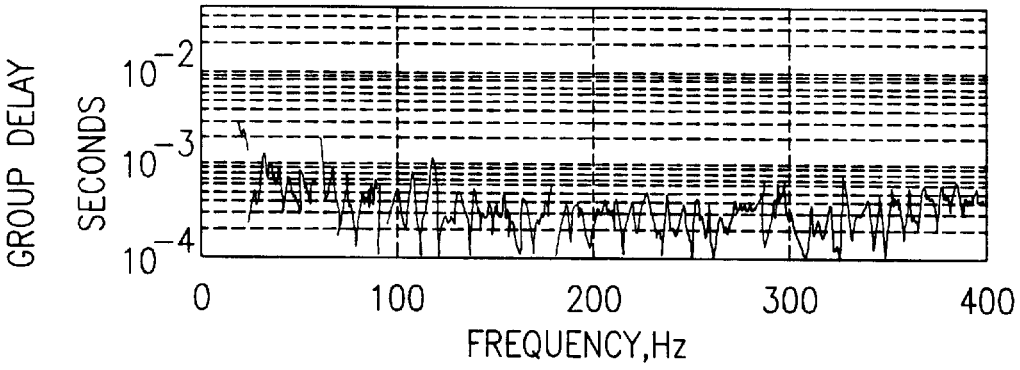
FIG. 10 is the group delay vs. frequency for a closed loop or servoed loudspeaker.

A measure of the average system group delay, as previously stated, is obtained from the derivative of the phase response curve with respect to frequency. FIG. 9 illustrates the group delay of the open loop control loudspeaker. FIG. 10 shows the group delay of a closed loop loudspeaker. As indicated the group delay for both loudspeakers is inversely related to frequency. That is, increasing group delays occur at decreasing frequencies. When compared with open look control, the closed loop group delay has been reduced, on average, by a factor of 8–10 over most of the indicated frequency range.

From this analysis we see that the two merits of utilizing a servo controlled loudspeaker for duct ANC applications is 1) the reduced group delay and 2) to provide an idealized source. Group delays have been reduced by a factor of about ten and the amplitude approaches unity.

Although a preferred embodiment of the present invention has been illustrated and described, other changes will occur to those skilled in the art. For example, other means for determining cone velocity may be used. It is therefore intended that the scope of the present invention is to be limited only by the scope of the appended claims.

What is claimed is:

1. A duct active noise cancellation circuit having a noise canceling loudspeaker having a coil for driving said loudspeaker and means for supplying a driving signal to said coil for causing said loudspeaker to produce a noise canceling signal, a closed-loop velocity servo for said loudspeaker comprising:

a resistor in series with said coil and located intermediate said means for supplying a driving signal and said coil;

means located across said resistor for determining the voltage drop across said resistor and the current in said resistor and for producing a voltage output proportional to said determined current;

a circuit receiving said voltage output and producing a signal representative of the velocity of said coil; and means for adjusting said means for supplying a driving signal responsive to said signal representative of the velocity of said coil.

2. The duct active noise cancellation circuit of claim 1 wherein said circuit receiving said voltage output includes a gain in parallel with a frequency dependent filter.

3. The duct active noise cancellation circuit of claim 2 further including a first adder receiving output from said gain and said frequency dependent filter and for producing an output; and a second adder receiving a first input from said first adder as a negative input and a second input representing an input supplied to said means for supplying a driving signal.

4. A duct active noise cancellation circuit having a noise canceling loudspeaker and means for supplying a driving signal to said loudspeaker for causing said loudspeaker to move and thereby produce a noise canceling signal, a closed-loop velocity servo for said loudspeaker comprising:

means for sensing movement of said loudspeaker and for producing a signal representative of movement of said loudspeaker;

a circuit receiving said signal representative of movement of said loudspeaker and producing a signal representative of the velocity of said movement of said loudspeaker; and means for adjusting said means for supplying a driving signal responsive to said signal representative of the velocity of said movement of said loudspeaker.

5. A duct active noise cancellation system having a noise canceling loudspeaker having a coil for driving said loudspeaker and means for supplying a driving current to said coil for causing said loudspeaker to move and thereby to produce a noise canceling signal, a closed-loop velocity servo for said loudspeaker comprising:

means for determining the motion of the said loudspeaker; and means for supplying auxiliary driving current to the said loudspeaker that is responsive to the motion of the said loudspeaker.

6. In a duct active noise cancellation circuit having a noise canceling loudspeaker having a coil for driving said loudspeaker and means for supplying a driving signal to said coil for causing said loudspeaker to produce a noise canceling signal, the method of correcting the noise canceling signal comprising the steps of:

producing a voltage output proportional to a determined current driving said loudspeaker;

receiving said voltage output and producing a signal representative of the velocity of said coil; and adjusting said means for supplying a driving signal responsive to said signal representative of the velocity of said coil.

7. In a duct active noise cancellation circuit having a noise canceling loudspeaker and means for supplying a driving signal to said loudspeaker for causing said loudspeaker to move and thereby produce a noise canceling signal, the method of correcting the noise canceling signal comprising the steps of:

sensing movement of said loudspeaker and producing a signal representative of movement of said loudspeaker;

receiving said signal representative of movement of said loudspeaker and producing a signal representative of the velocity of said movement of said loudspeaker; and adjusting said means for supplying a driving signal responsive to said signal representative of the velocity of said movement of said loudspeaker.

8. In a duct active noise cancellation system having a noise canceling loudspeaker having a coil for driving said loudspeaker and means for supplying a driving current to said coil for causing said loudspeaker to move and thereby to produce a noise canceling signal, the method of correcting the noise canceling signal comprising the steps of:

determining the motion of the said loudspeaker; and supplying auxiliary driving current to the said loudspeaker that is responsive to the motion of the said loudspeaker.

* * * * *